United States Patent [19]

Florencio Perez et al.

[11] Patent Number: 5,060,822

[45] Date of Patent: Oct. 29, 1991

[54] CONFECTIONERY SUPPLYING MACHINE

[75] Inventors: Antonio Florencio Perez, Gran Via de la Corts Catalanes, 1128 Barcelona, Spain; Alberto Vivancos Gil, Prat de la Manta, 65-08092 Hospitalet de Llobregat, Barcelona, Spain; Antonio Alcantara Munoz, Taulat, 191 08005 Barcelona, Spain

[73] Assignees: Antonio Florencio Perez; Antonio Alcantara Munoz; Alberto Vivancos Gil, all of Barcelona, Spain

[21] Appl. No.: 544,541

[22] Filed: Jun. 28, 1990

[30] Foreign Application Priority Data

Jan. 3, 1990 [ES] Spain ..... 9000013

[51] Int. Cl.[5] ..... B65G 59/00

[52] U.S. Cl. ..... 221/268; 221/283; 221/287

[58] Field of Search ..... 221/268, 269, 283, 287

[56] References Cited

U.S. PATENT DOCUMENTS 1,761,009 6/1930 DeVries ..... 221/283

2,303,880 12/1942 Hilton et al. ..... 221/287

2,426,999 9/1947 Hilton et al. ..... 221/269

3,161,320 12/1964 Swanson ..... 221/269

*Primary Examiner*—H. Grant Skaggs

*Attorney, Agent, or Firm*—Cushman, Darby & Cushman

[57] ABSTRACT

For manually dispensing successively lowermost articles from a stack, the stack is housed in a device which includes a downwardly opening container removably supported in an upwardly and frontally opening box portion of a support. An article removal slide is received in a slot defined between a bottom wall of the box and the lower edge of the container. An upwardly projecting tang, at the back of the slide, drags the lowermost article forwards, out of the slot, as a handle on the front of the slide is pulled forward. Detents in sidewalls of the box above the bottom wall removably mount to complementary features on the container side walls. Guides and an out-stop are provided between the article removal slide and the box bottom wall. The slide is received in a central recess in the box bottom wall. Flanking surfaces of the box bottom wall support the lowermost article which also rests on the slide.

5 Claims, 3 Drawing Sheets

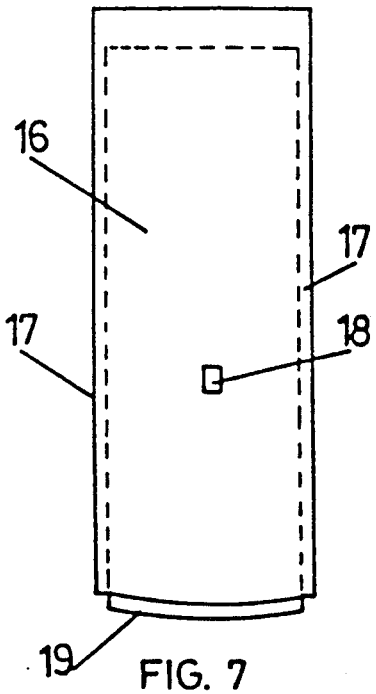
FIG. 7
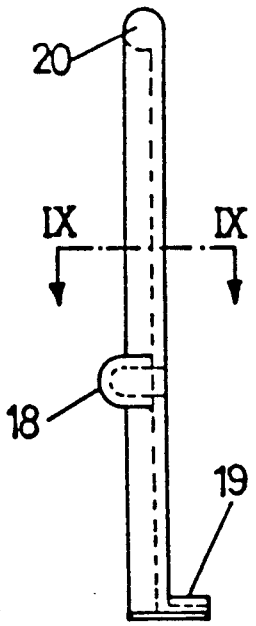
FIG. 8
FIG. 10
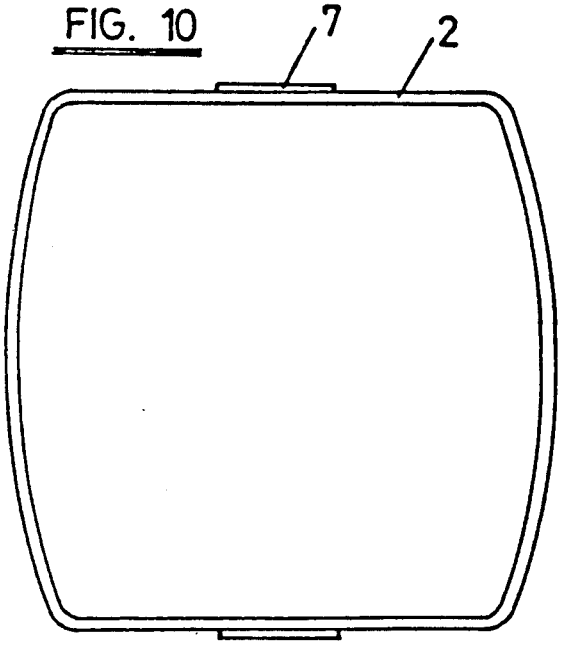
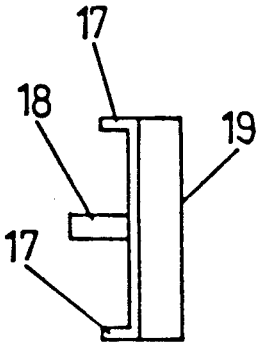
FIG. 9

CONFECTIONERY SUPPLYING MACHINE

BACKGROUND OF THE INVENTION

This invention refers to a machine that makes confectionery and more specifically, flat pieces of confectionery such as biscuits.

The machine is manually operated and includes a container in which the confectionery pieces are stored, stacked on top of each other, and removed through the mouth at the bottom.

Machines for supplying pieces of confectionery in packets are already known, consisting of a vertical container that has an opening in one of the lateral walls. The bottom of the container slopes downwards towards the opening and is prolonged through the opening by means of a ramp upon which the units placed in the lower part of the container slide until they reach a retention element formed by the ramp. The products are thus exposed on the ramp, from where they can be taken, and more units descend as the ones on the ramp are removed.

The machines of the type described above are useful for packaged items or items with a protective wrapping, since although they remain outside the container, exposed for direct access by the consumer, the product is duly protected by the carton or wrapper.

However, in the case of bulk confectionery pieces, without cartons or protective wrapping, the machines of the type described above cannot be used for providing these items, since the units placed on the exit ramp remain outside the container, with no protection and thus exposed to external conditions, for example dust and enter into direct contact with the potential consumers.

SUMMARY OF THE INVENTION

The purpose of this invention is to provide a machine for supplying confectionery products, preferably flat and without wrappers or cartons, in such a way that these products or pieces of confectionery can be preserved from undesirable external agents, as well as direct contact with potential consumers, maintaining the product in perfect hygenic conditions.

The machine invented includes of a support, a vertical container at the top, mounted upon the support, and a hatch for extracting the pieces. The vertical container includes a straight prismatic container, which is generally square in shape, and whose inside is practically the same shape as the confectionery pieces, to be stored inside it. The bottom is open. The extraction hatch includes a plate that is mounted on the support, so that it slides, placed immediately below the vertical container. Between this container and the hatch is an outlet for the confectionery pieces.

The support has a central box at the bottom, which opens onto the front of the machine, and which is the right size for receiving the lower part of the vertical container. The box is generally the same size as the outside of the container. The box on the support has an intermediate step along its three closed walls, upon which the free corner of three of the walls of the tank rest. The box and walls of the tank also have anchoring means for this tank.

The plate forming the removal hatch is mounted on the support box, underneath the step where the tank rests, within a central longitudinal hollow formed at the bottom of the box. This hollow opens out onto the front of the machine, together with the box, and has a guide to enable the plate to slide lengthways. The plate projects from the box within a part that has handles for gripping, and the inside transversal edge of a ledge that serves as a stop for sliding and removing the pieces through the outlet.

The hollow at the bottom of the box in which the removal hatch is located has two longitudinal channels at the ends, one at each side, into which the corresponding lower longitudinal flaps of the hatch plate protrude. The bottom of the hollow also has a central longitudinal groove into which a lower central ledge of this plate protrudes, defining the guides and plate retention mechanisms.

The anchoring of the tank to the support is done by small hollows and flaps that fit into each other in the surfaces of the box and tank.

The step of the box upon which the tank rests is located above the upper surface of the hatch plate, at a height approximately equal to or slightly higher than the thickness of one of the confectionery pieces in the tank. The posterior transversal flap of the hatch is of the same height or is slightly lower than these pieces.

With the configuration described upon above, the confectionery pieces are stacked in the tank or container, resting upon the lower hatch. Each time the hatch is moved manually outwards, the piece occupying the lower position is dragged along, and protrudes outside through the opening between the lower edge of the front wall of the container and the hatch. Removal from the hatch takes place in such as way that the consumer can take the piece of confectionery and the stack of pieces located inside the container remains intact, descending when the hatch is inserted, and the piece occupying the lower place of the column rests on the upper surface of the hatch. The machine is thus ready for a new removal.

BRIEF DESCRIPTION OF THE DRAWING

The attached drawings show as a non-restrictive example, a possible way of performing the operation:

FIG. 7 is a top plan view of the floor of the removal hatch.

FIG. 8 is a side elevation view of the removal hatch.

FIG. 9 is a transverse cross-sectional view of the hatch, on line IX—IX of FIG. 8.

FIG. 10 is a transverse cross-sectional view of the tank portion of the machine.

DETAILED DESCRIPTION

Figure 2:
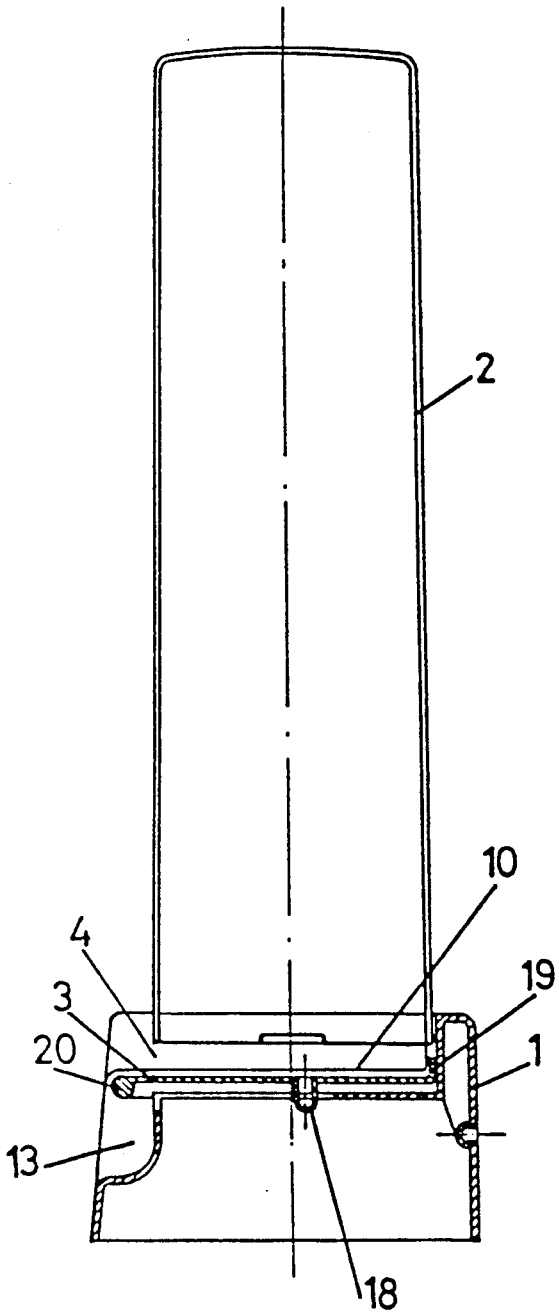
FIG. 2 is a longitudinal cross-sectional view thereof on line II—II of FIG. 1.

As can be seen in the drawings, the machine for supplying pieces of confectionery includes a support 1, a vertically elongated container or tank 2, which is mounted upon support 1 and is intended to contain the confectionery products (not shown) stacked on top of each other, and by means of a removal hatch 3, mounted upon support 1 in such a way that it slides, immediately below the vertical container 2. Between the hatch 3 and container 2 is an opening or outlet 4.

Figure 1:
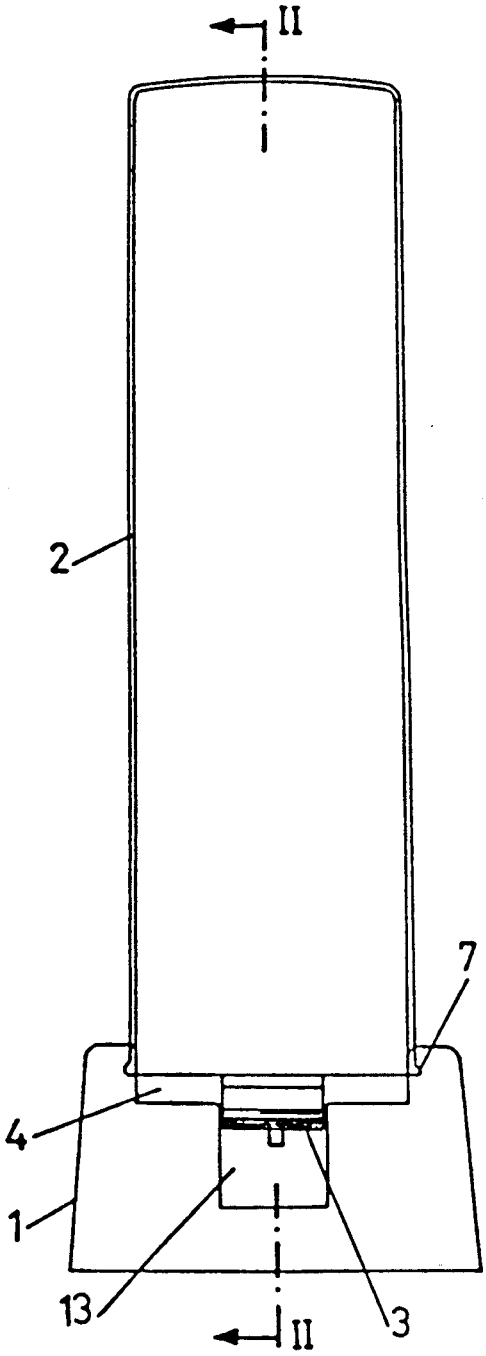
FIG. 1 is a front elevation view of a machine that is made up in accordance with the principles of the present invention.
Figure 3:
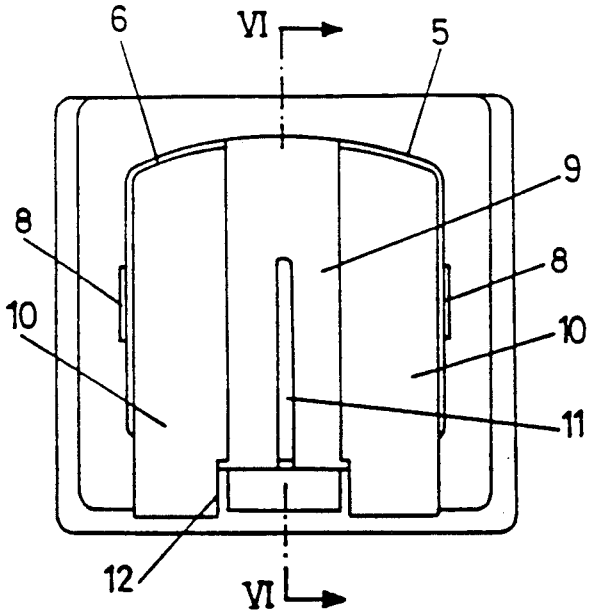
FIG. 3 is a top plan view of the support portion of the machine.
Figure 6:
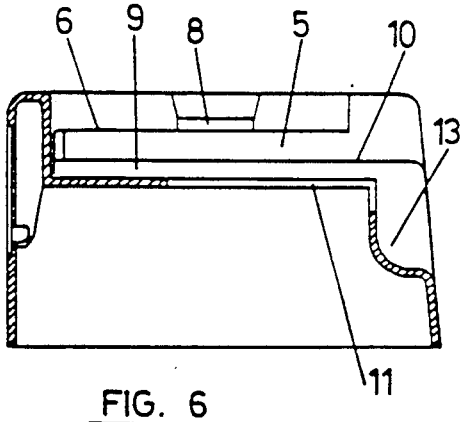
FIG. 6 is a longitudinal cross-sectional view of the support, on line VI—VI of FIG. 3.
Figure 4:
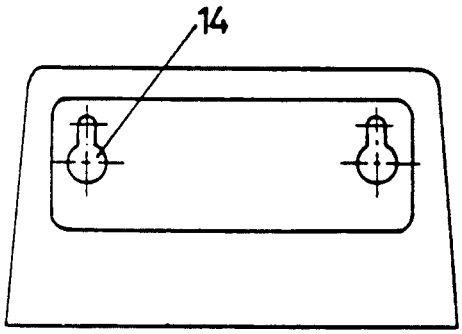
FIG. 4 is a rear elevation view of the support.

The vertical container 2, as seen in FIGS. 1, 2, and 10, includes a generally straight prismatic tank, with a square base, open at the bottom.

Support 1, as seen in FIGS. 3 to 6, is made up of a hollow body, shaped generally like a straight-sided rectangular prism, which has a three-sided, open-fronted, upwardly opening, box-like recess 5, formed in the upper end wall thereof, that opens but into the front wall of the support and has the appropriate size to receive a lower part of container 2. This box has, along its three closed walls, an intermediate step 6, upon which the free lower edge of three of the walls of tank 2 rest, as seen in FIGS. 1 and 2. The transverse cross-sectional shape of box 5 is generally the same as the perimetrical shape of the outside of tank 2. Two of the opposite walls of tank 2 have a small flap 7 which is inserted into hollows or openings 8 formed in the two parallel left and right (laterally opposite) side walls which limit the box 5, and serve as anchorage of container 2 in support 1.

The bottom of box 5 has a central longitudinal hollow 9, which also opens out at the front part and defines on its two laterally opposite flanks two lateral plateaus 10. At the bottom of hollow 9 is a longitudinal groove 11 which opens out at the front part. The longitudinal hollow 9 widens slightly at the anterior portion 12. The frontal wall of support 1 also has an upper hollow 13 which coincides with the longitudinal hollow 9 of the upper base. The posterior wall of support 1 has openings 14 for hanging.

Figure 5:
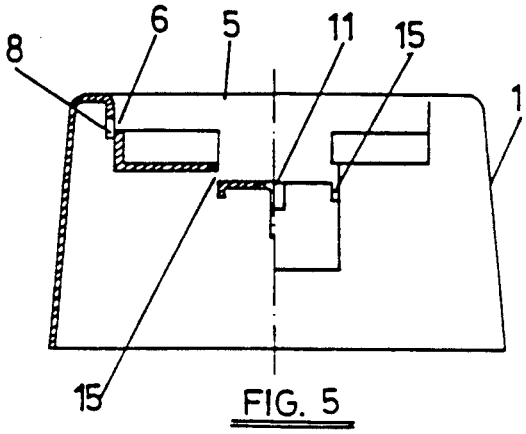
FIG. 5 is a front elevation view of the support with a left-frontal portion broken away and sectioned.

At both sides of the central hollow 9 are corresponding grooves 15, as seen in FIG. 5.

Hatch 3, seen in FIGS. 7–9, includes a rectangular plate 16, whose width is approximately the same as hollow 9 of the support 1, but longer. This plate 16 has on its lower surface two longitudinal flaps 17 which are inserted along the channels or grooves 15 limiting the hollow 9. Plate 16 also has on its lower surface a central flap 18 which is inserted into groove 11 of the support hollow. Finally, plate 16 ends in an upper transversal wall 19 and anterior rib or flap 20.

As constituted above, the plate making up the hatch is mounted as seen in FIG. 2 upon hollow 9 of the support, with longitudinal flaps 17 in the channels or longitudinal grooves 15 of the hollow and lower flap 18 of the hatch in groove 11 of the bottom of the hollow, and the flap or ledge 20 points towards the outside, projecting from the frontal hollow 13 of the support and serving as a handle of the hatch.

The machine described above is specially designed for the supply of biscuits or similar confectionery pieces, which are stacked inside the container 2. These biscuits or confectionery pieces rest on the plateaus 10 which are on both sides of the longitudinal hollow 9. When removing the hatch 3, the back transversal wall 19 of the same drags forwards the biscuit at the bottom of the stack of biscuits housed in the container tank, and when that biscuit has, as a result, been dragged sufficiently far forwards, it can be removed through the opening 4. The lower flap 18 of the hatch limits the extraction. As soon as the biscuit or piece of confectionery dragged through hatch 3 has been totally removed, and the removal hatch or slide plate 3 has been pushed back in to its FIG. 2 position, the remaining biscuits in the stack fall downwards until they rest on platforms 10, and the machine is ready for a new removal to be made.

Outlet 4 will be the same height or slighly higher than the thickness of a biscuit. The back transversal wall 19 of the hatch will be of such a height that only one biscuit can be removed at a time.

The machine described above may be used in public establishments or private households, as a biscuit container, and removal of the biscuits is extremely easy, since the activation of hatch 3 is sufficient, and the biscuits are perfectly protected. When the contents of the machine have been exhausted, the storage tank 2 should be dismounted, filled with biscuits, support 1 fitted and the combined tank and suport inverted so as to have its FIG. 1 orientation once more and placed on a flat surface or hung by hooks using the openings.

We claim:

1. A device for successively dispensing individually lowermost articles such as a confectionery piece having a predetermined size and shape in plan, from the bottom of a stack of such articles, comprising:

A vertically elongated container having a generally square transverse cross-sectional shape, and including a front wall, a real wall, and two laterally opposite side walls, these walls having a lower edge perimetrically surrounding a bottom opening;

a support comprising wall means defining an upwardly open box having a bottom wall, a rear wall, and left and right laterally opposite side walls; said box being frontally open, and sized and shaped to telescopically receive a lower end portion of said container, including said lower edge;

surface means on said laterally opposite side walls of said container disengageably engaged with surface means on said laterally opposite side walls of said box and thereby releasably supporting said container on said support with said lower edge of said container spaced above said floor of said box frontally of said box, thereby defining an outlet slot extending widthwise of said box;

said bottom wall of said box having means defining a central, upwardly opening recess elongated in a front-to-rear direction of said box, said recess being laterally narrower than said bottom wall, so that two article support surfaces are defined on said bottom wall flanking laterally opposite edges of said recess;

an article removal plate slidingly received in said box through said outlet slot and disposed in said recess so as to have an upwardly facing support surface that is generally coplanar with said two flanking article support surfaces of said bottom wall of said box; said article removal plate being slidable between an extended position and a retracted position, said article removal plate extending forwardly from said slot to a greater extent when in said extended position than when in said retracted position;

said article removal plate being generally rectangular in plan and having at a forward end thereof a handle means which is manually accessible from externally of said device, for sliding said article removal plate forwards and rearwards through said slot;

said article removal plate further including an upwardly projecting, laterally extending article engagement flange provided thereon at a location distally of said handle means for engagement behind a lowermost article support on said support surfaces of said bottom wall of said box and said article removal plate when said article removal plate is in said retracted position, for dragging said lowermost article forwardly and at least partly out of said device through said slot as said article removal plate is slid forwards to said extended position by manually pulling outwards on said handle means;

interengaging guide means on said article removal plate and on said box, for guiding said plate as said plate is slid between said extended and retracted positions thereof; and stop means provided on said article removal plate and arranged to engage with said support for limiting outward sliding of said article removal plate, and thereby defining said extended position of said article removal plate.

2. The dispensing device of claim 1, wherein:

said surface means on said container comprise laterally outwardly protruding tangs; and said surface means on said box comprise medially opening recesses in said laterally opposite sidewalls of said box, located at intermediate heights on said laterally opposite sidewalls of said box and arranged to removably receive said tangs.

3. The dispensing device of claim 1, wherein:

said interengaging guide means comprise two laterally spaced downwardly projecting flanges on said article removal plate, slidingly received in respective upwardly opening grooves in said bottom wall of said box; and said stop means comprises a downwardly projecting pin on said article removal plate received in means defining a slot in said bottom wall of said box.

4. The dispensing device of claim 1, further including:

means defining at least one rearwardly opening slot on a rearwardly facing outer surface of said support, each said slot being arranged for permitting said device to be hangingly supported thereby from a wall-mounted hanger.

5. The dispensing device of claim 1, wherein:

said handle means comprises a downwardly projecting laterally extending flange which is available for grasping from frontally of and below said article removal plate.

* * * * *